US008915227B2

(12) United States Patent
Johng

(10) Patent No.: US 8,915,227 B2
(45) Date of Patent: Dec. 23, 2014

(54) SPARK PLUG OF AN INTERNAL COMBUSTION ENGINE

(76) Inventor: In Tae Johng, Seoul (KR)

( * ) Notice: Subject to any disclaimer, the term of this patent is extended or adjusted under 35 U.S.C. 154(b) by 500 days.

(21) Appl. No.: 13/501,900

(22) PCT Filed: Oct. 13, 2010

(86) PCT No.: PCT/KR2010/007000

§ 371 (c)(1),
(2), (4) Date: Jun. 13, 2012

(87) PCT Pub. No.: WO2011/046364

PCT Pub. Date: Apr. 21, 2011

(65) Prior Publication Data

US 2012/0240890 A1 Sep. 27, 2012

(30) Foreign Application Priority Data

Oct. 14, 2009 (KR) ..... 10-2009-0097694

(51) Int. Cl.

| | |
|---|---|
| ***H01T 13/02*** | (2006.01) |
| ***H01T 13/54*** | (2006.01) |
| ***F02P 13/00*** | (2006.01) |
| *F02P 9/00* | (2006.01) |

(52) U.S. Cl.

CPC ..... *H01T 13/54* (2013.01); *F02P 13/00* (2013.01); *F02P 9/007* (2013.01)

USPC ..... 123/169 P; 123/262; 313/143

(58) Field of Classification Search

CPC ..... H01T 13/54; H01T 13/16; H01T 13/24; H01T 13/40; H01T 13/28; F02B 19/12; F02B 23/08; F02B 19/1004; F02B 19/1014

USPC ..... 123/169 P, 169 PA, 169 PH, 260, 262, 123/263, 266, 306, 309; 313/143

See application file for complete search history.

(56) References Cited

U.S. PATENT DOCUMENTS 4,108,136 A * 8/1978 Hideg et al. ..... 123/209
4,128,081 A * 12/1978 Noguchi et al. ..... 123/262

(Continued)

FOREIGN PATENT DOCUMENTS

KR 1020040103476 12/2004
KR 100701571 B1 3/2007

(Continued)

OTHER PUBLICATIONS

Jul. 27, 2011 International Search Report for International Application No. PCT/KR2010/007000.

*Primary Examiner* — Thomas Moulis
(74) *Attorney, Agent, or Firm* — Howard & Howard Attorneys PLLC

(57) ABSTRACT

A spark plug of internal combustion engine is disclosed. The spark plug includes: a main body having main thread on lower outer side; an insulator mounted in a hollow portion of the main body; a ground electrode to correspond to a central electrode extending from the lower end of the terminal rod; a primary combustion chamber forming shell having female thread to be screw-coupled with the main thread, male thread to fix a combustion chamber, and an ejection hole; the primary combustion chamber formed between the main body and the primary combustion chamber forming shell and having changeable volume; and a heat exchange member disposed between the main body and the insulator to exchange heat caused by flame and to block leak of volatile gas; wherein the main ejection hole has a single main ejection hole and at least two auxiliary ejection holes formed around the main ejection hole.

7 Claims, 6 Drawing Sheets

(56) References Cited

U.S. PATENT DOCUMENTS

| | | | | | |
|---|---|---|---|---|---|
| 4,218,992 | A | * | 8/1980 | Latsch et al. | 123/263 |
| 4,267,482 | A | * | 5/1981 | Iwata et al. | 313/143 |
| 4,305,357 | A | * | 12/1981 | Scherenberg et al. | 123/254 |
| 4,332,224 | A | * | 6/1982 | Latsch et al. | 123/254 |
| 4,513,708 | A | * | 4/1985 | Latsch et al. | 123/263 |
| 4,534,327 | A | * | 8/1985 | Latsch et al. | 123/263 |
| 4,930,473 | A | * | 6/1990 | Dietrich | 123/266 |
| 5,105,780 | A | * | 4/1992 | Richardson | 123/263 |
| 5,554,908 | A | * | 9/1996 | Kuhnert et al. | 313/140 |
| 7,770,552 | B2 | * | 8/2010 | Schultz | 123/143 B |
| 7,922,551 | B2 | * | 4/2011 | Tozzi | 445/7 |
| 8,104,444 | B2 | * | 1/2012 | Schultz | 123/143 B |
| 8,143,772 | B2 | * | 3/2012 | Francesconi | 313/118 |
| 2005/0211217 | A1 | * | 9/2005 | Boley et al. | 123/266 |
| 2010/0147259 | A1 | * | 6/2010 | Kuhnert et al. | 123/260 |

FOREIGN PATENT DOCUMENTS

| | | |
|---|---|---|
| KR | 1020090017250 | 2/2009 |
| KR | 1020090041757 | 4/2009 |

* cited by examiner

SPARK PLUG OF AN INTERNAL COMBUSTION ENGINE

FIELD OF INVENTION

The present invention relates to a spark plug of an internal combustion engine, and more particularly to a spark plug of an internal combustion engine being utilized in internal combustion engines of various volumes because of allowing to vary a volume of a primary combustion chamber according to a volume of a main combustion chamber and for preventing misfire from improved structure and enhancing efficiency.

BACKGROUND OF INVENTION

In order to achieve combustion efficiency of optimum output required to a high performance internal combustion engine that uses gasoline of high octane number, ignition is done at an angle of −5 degrees to −6 degrees (±) before top dead center (BTDC) in a case of a low revolution per minute according to respective RPMs of the internal combustion engine and advance ignition timing is also set to BTDC of 50 degrees (±) as RPM increases so as to obtain maximum output of the internal combustion engine.

A fuel supplying system includes an electronic control unit (ECU) which is mounted to an engine and supplies a predetermined amount of fuel through fuel nozzles very sensitively suitable for stoichiometric ratio in proportion to temperature change of the engine and an amount of intake air so that the function of controlling maximum fuel consumption rate of the engine can be enhanced and that exhaust of blow by gas such as hydrocarbon gas (HC), carbon monoxide (CO), carbon dioxide (CO2), etc., can be controlled resulting in optimized performance of the engine.

However, the above described mechanism for obtaining the maximum output of an engine cannot reduce emission of nitrogen oxide (NOx) and this problem is more serious in vehicles using liquefied petroleum gas (mixture of propane and butane).

In order to reduce the harmful nitrogen oxide (NOx) lower than optimal environmental regulations, an expensive emission control catalyst converter is attached to a proper portion through which exhaust gas is discharged from an engine such that the amount of the nitrogen oxide is controlled to be lower than standard environmental regulations. However, in this case, due to the fine nature of the catalyst, accumulation of the uncombusted hydrocarbon causes blocking, melting and damage of the converter.

In order to reduce discharge of the nitrogen oxide, various types of precombustion chambers such as a encapsulated type, a tube type, and a precombustion chamber to which a cover is fixed and inlet and outlet holes are proposed to promote combustion in combustion chambers and there is an attempt to improve performance and fuel combustion ratio of an engine using lean burn fuel ratio. However, since reduction of the composition of fuel ratio or overheat at the TDC brings misfire and abnormal ignition and consequently new problems such as reduction of output and lowering of performance of a high performance engine arise, the above proposal is not substantially applied to the LPG internal combustion engine.

The above-described problems, in the internal combustion engine using LPG, develope into phenomenon in which metal such as an encapsulated cover of a spark plug of a primary combustion chamber exceeds the heat range of the spark plug due to high heat in a cylinder where the high temperature combustion stroke is carried out and vortex heat source gas or detonation such as pre-ignition occurs in the compression stroke due to overheating in the next stroke caused by other reasons resulting in stopping the engine. Therefore, more reliable improvement is required.

To address this problem, this applicant proposed a spark plug including a main body, a central electrode, a pair of ground electrodes disposed close to a hollow lower end around the central electrode to form an arc shape, a flame exchanging orifice valve surrounding the pair of electrodes at the lower side of the main body to form a primary combustion chamber in which the electrodes are accommodated and to form an ignition hole in Korean Patent No. 0328490. In this patent, the spark plug includes a main ignition hole formed at the central area of the orifice valve and a cap formed with at least two auxiliary ignition holes outside of the main ignition hole and coupled with the lower side of the main body to surround the ground electrodes.

According to the proposal, some of compressed mixture fuel of an internal combustion engine is temporally ignited and burnt at an ignition timing of the engine in advance and a small scale of burning flame occurring from the ignition and burning is discharged into the main combustion chamber to ignite the main combustion chamber so that the combustion performance is maximized and that the combustion performance may be improved through the flame exchanging ignition holes through which the discharging gas passes in comparison with existing spark plugs. However, since excessively small flame is transferred to the combustion chamber, only restricted improvement of ignition performance can be obtained, and thus, a spark plug having precombustion performance by an expandable large volume in response to the purpose of an internal combustion engine and a large cylinder is required. In addition, according to the existing spark plug, the orifice valve is melted by high temperature flame so that lifetime of the spark plug is shortened or misfire may occur. Moreover, the precombustion occurs beyond heat range of the spark plug due to the orifice valve so that misfire occurs and the heat range should be adjusted properly to high performance revolutions of the internal combustion engine.

DISCLOSURE OF THE INVENTION

Technical Problem

Therefore, the present invention has been made in view of the above problems, and it is an object of the present invention to provide a spark plug of an internal combustion engine capable of changing a volume of a primary combustion engine to control combustion speed according to a volume of a main combustion chamber of the internal combustion engine.

The present invention also provides a spark plug of an internal combustion engine such as an LPG internal combustion engine and an air cooled engine of a two-wheeled vehicle for improving type of an ejection hole, a central electrode, and an auxiliary electrode to prevent misfire and combustion efficiency.

Technical Solution

In accordance with an exemplary embodiment of the present invention, there is provided a spark plug of an internal combustion engine including: a main body having a main thread formed on the lower outer side thereof by a predetermined length; an insulator mounted in a hollow portion of the main body while coating a terminal rod which is embedded in the central area of the main body with insulating material; a ground electrode formed on the lower inside of the main body to correspond to a central electrode extending from the lower end of the terminal rod to be exposed to the outside; a primary combustion chamber forming shell having female thread formed on an inner surface of an opening to be screw-coupled with the main thread, male thread formed on the outer surface to fix a combustion chamber, and an ejection hole formed on the lower end; the primary combustion chamber formed between the main body and the primary combustion chamber forming shell to accommodate the central electrode and the ground electrode and having a volume of which is adjusted by a screw coupling length between the main body and the primary combustion chamber forming shell; and a heat exchange member which is disposed between the main body and the insulator to exchange heat caused by flame generated by ignition by the central electrode and the ground electrode and to block leak of volatile gas; wherein the main ejection hole has a single main ejection hole formed at the central area of the lower end of the primary combustion chamber forming shell and at least two auxiliary ejection holes formed around the main ejection hole in the circumferential direction to be inclined laterally to form a vortex of the flame discharged from the primary combustion chamber.

The spark plug may further include at least one washer disposed between the main body and the primary combustion chamber forming shell to secure the screw coupling between the main body and the primary combustion chamber forming shell.

The washer may vary in thickness and number according to a volume of the primary combustion chamber to be disposed between the main body and the primary combustion chamber.

The heat exchange member may be made of an alloy of copper and heat resistant aluminum or iron.

The ground electrode may include two ground electrodes formed around the central electrode symmetrically.

The ground electrode may include a penetrating passage hole through which a fuel gas mixture passes.

The central electrode may include a recess formed at a site facing the ground electrode to increase residual time of the fuel gas mixture.

Advantageous Effects

According to the spark plug of the present invention, since the coupling length of a primary combustion chamber forming shell to be fastened to a main body is adjusted to change a volume of the primary combustion chamber, combustion speed can be controlled by changing the volume of the primary combustion chamber according to a volume of the main combustion chamber of an internal combustion engine. Thus, the spark plug can be applied to internal combustion engines with various volumes.

In addition, the spark plug of the present invention has a simple in its structure and is easily made resulting in reduction of manufacturing costs, has high abrasion resistance, and does not easily malfunction. Since the spark plug of the present invention may be manufactured by coupling the primary combustion chamber forming shell to an existing spark plug, the existing spark plugs may be utilized.

Moreover, an auxiliary ejection hole is laterally inclined to form vortex of flame discharged from the primary combustion chamber so that misfire by the spark plug is prevented and combustion efficiency can be improved.

Furthermore, a passage hole through which fuel gas mixture passes is formed on the ground electrodes or a hole for increasing residual time of the fuel gas mixture is formed at a site of the central electrode facing the ground electrode so that misfire can be prevented.

BEST MODE FOR CARRYING OUT THE INVENTION

Hereinafter, a spark plug according to exemplary embodiments of the present invention will be described in detail with reference to the accompanying drawings. Particular terms may be defined to describe the invention in the best manner. Accordingly, the meaning of specific terms or words used in the specification and the claims should not be limited to the literal or commonly employed sense, but should be construed in accordance with the spirit of the invention.

The description of the various embodiments is to be construed as exemplary only and does not describe every possible instance of the invention. Therefore, it should be understood that various changes may be made and equivalents may be substituted for elements of the invention.

Figure 1:
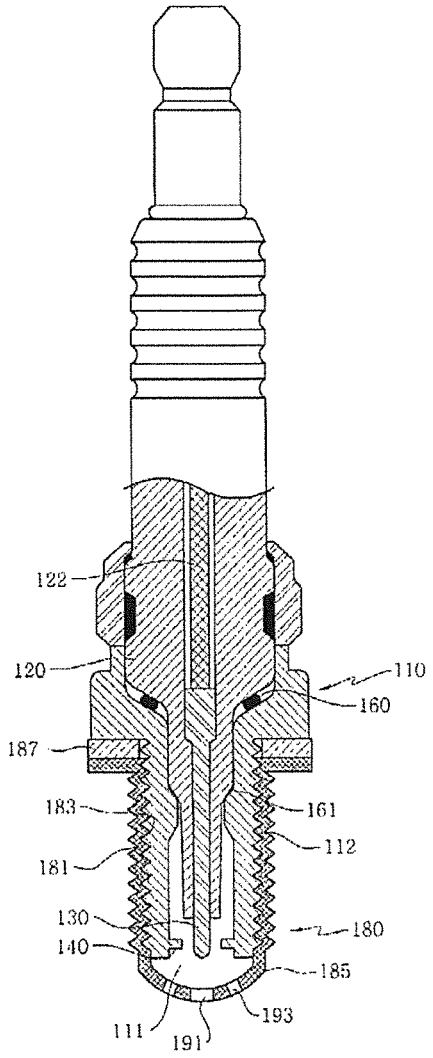
FIG. 1 is a sectional view illustrating a spark plug according to an exemplary embodiment of the present invention.

FIG. 1 is a sectional view illustrating a spark plug according to an exemplary embodiment of the present invention.

As illustrated in FIG. 1, a spark plug according to an exemplary embodiment of the present invention includes a main body 110 having a hollow portion, an insulator 120 mounted in the hollow portion of the main body 110, a central electrode 130 extending from lower end of a terminal rod 122 embedded in the insulator 120 to be exposed to the outside, a ground electrode 140 formed on the lower inside of the main body 110 to correspond to the central electrode 130, a primary combustion chamber forming shell 180 coupled to the main body 110 to form a primary combustion chamber 111, the primary combustion chamber 111 a volume of which is controlled according to a screw coupling length between the main body 110 and the primary combustion chamber forming shell 180, an washer 187 disposed between the main body 110 and the primary combustion chamber forming shell 180 to fasten the screw coupling between the main body 110 and the primary combustion chamber forming shell 180.

A main thread 112 is provided on the lower outer side of the main body 110 by a predetermined length to perform the screw coupling with the primary combustion forming shell 180 and the primary combustion chamber 111 is formed therebetween when the main body 111 and the primary combustion chamber forming shell 180 are coupled with each other.

The insulator 120 is mounted in the hollow portion of the main body 110 while the terminal rod 122 embedded in the central portion of the main body 110 is coated with insulator.

Heat exchange members 160 and 161 are disposed between the main body 110 and the insulator 120. The heat exchange members 160 and 161 exchange high temperature heat occurring from flame generated in the primary combustion chamber with the outside and block leak of volatile gas. The heat exchange members 160 and 161 may be made of various kinds of metal, preferably an alloy of copper and aluminum having excellent heat exchange performance.

The central electrode 130 extends from the terminal rod 122 embedded in the insulator 120 and is exposed out of the insulator 120 to be placed within the primary combustion chamber 111.

The ground electrode 140 is positioned at the lower inside of the main body 110 to correspond to the central electrode 130 to form a spark cap from the central electrode 130. The ground electrode 130, in order to improve life span thereof, may have two or more ground electrodes.

The primary combustion chamber forming shell 180 has female thread 183 screwed with the main thread 112 formed on the outer circumference of the main body 110. The primary combustion chamber forming shell 180 also has male thread 181 for fixing a combustion chamber.

The primary combustion chamber forming shell 180 may be made of zirconium or compound thereof. Zirconium or compound thereof may prevent abnormal ignition due to high temperature heat because of low heat absorption rate (about 61%) and may improve life span under high heat and high pressure circumstance due to flame because of excellent corrosion resistance and heat resistance. The primary combustion chamber forming shell 180 may be also made of heat resistant steel such as tungsten carbide inconel 601.

Figure 2:
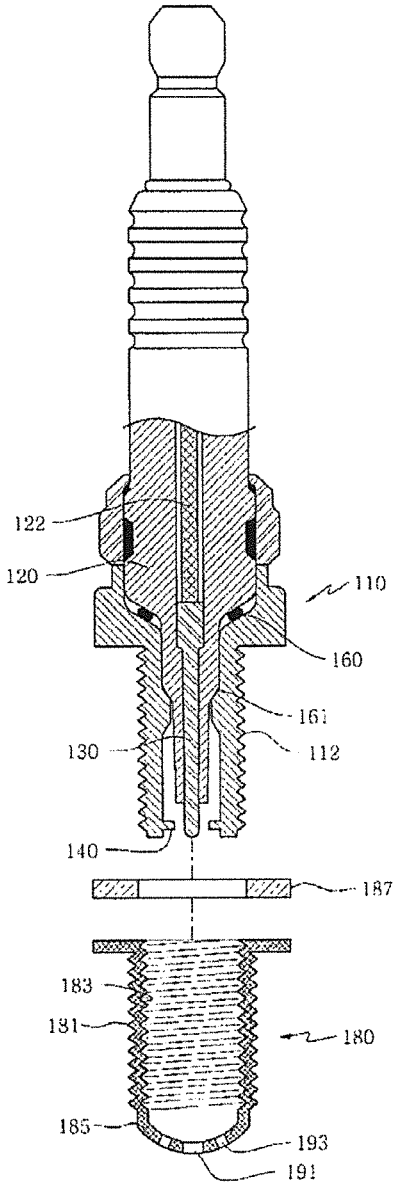
FIG. 2 is a sectional view illustrating a primary combustion chamber forming shell separated from a main body of the spark plug according to the exemplary embodiment of the present invention.

FIG. 2 is a sectional view illustrating the primary combustion chamber forming shell 180 separated from the main body 110 of the spark plug according to the exemplary embodiment of the present invention.

As illustrated in FIG. 2, in the spark plug of the present invention, since the main body 110 is easily separated from the primary combustion chamber forming shell 180, abnormality can be easily checked and only a part of the main body 110 and the primary combustion chamber forming shell 10 can be replaced when only the part is malfunctioned.

Figure 3:
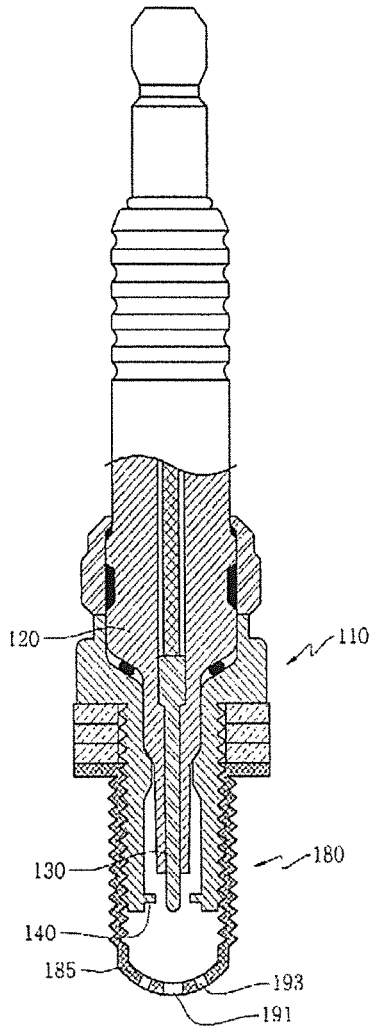
FIG. 3 is an assembly of a spark plug according to an exemplary embodiment in which a primary combustion chamber is increased.

FIG. 3 is an assembly of a spark plug according to an exemplary embodiment in which the primary combustion chamber 111 is increased.

The washer 187 is disposed to secure the screw coupling between the main body 110 and the primary combustion chamber forming shell 180. The screw coupling length between the main body 110 and the primary combustion chamber forming shell 180 must be adjusted according to a volume required to the primary combustion chamber 111. The screw coupling length may be adjusted by changing thickness of the washer 187 or the number of the washer 187.

The main combustion chamber of an internal combustion engine may have various volumes and the volume of the primary combustion chamber 111 must be properly adjusted according to the volume of the main combustion chamber. According to the spark plug of the present invention, combustion speed may be controlled by changing a volume of the primary combustion chamber 111 based on the main combustion chamber of the internal combustion engine, and the spark plug of the present invention can be applied to internal combustion engines with various volumes.

The washer 186 may be made of copper, for example.

An ejection hole is formed on a lower end 85 of the primary combustion chamber forming shell 180. When ignition is carried out by the spark cap between the central electrode 130 and the ground electrode 140, primary firing is carried out in the primary combustion chamber 111. At the same time, high-pressure flame is instantaneously ejected toward the main combustion chamber a pressure of which is lower than the primary combustion chamber 111 through the ejection hole to fire compressed gas at the TDC and to generate a driving force of the engine.

The ejection hole includes a main ejection hole 191 formed at the center of the lower end 185 of the primary combustion chamber forming shell 180. The ejection hole may further include two or more auxiliary ejection holes 93 formed around the main ejection hole 191 in the circumferential direction. Typically, the main ejection hole 191 is positioned at the center of the lower end 185 of the primary combustion chamber forming shell 180 and the two auxiliary ejection holes 193 are positioned about the main ejection hole 191 symmetrically. Otherwise, the main ejection hole 191 is positioned at the center of the lower end 185 of the primary combustion chamber forming shell 180 and four auxiliary ejection holes 193 may be positioned by every 90 degree about the main ejection hole 191. However, the number of the auxiliary ejection holes is not limited thereto but may be 5, 6, etc.

Figure 4:
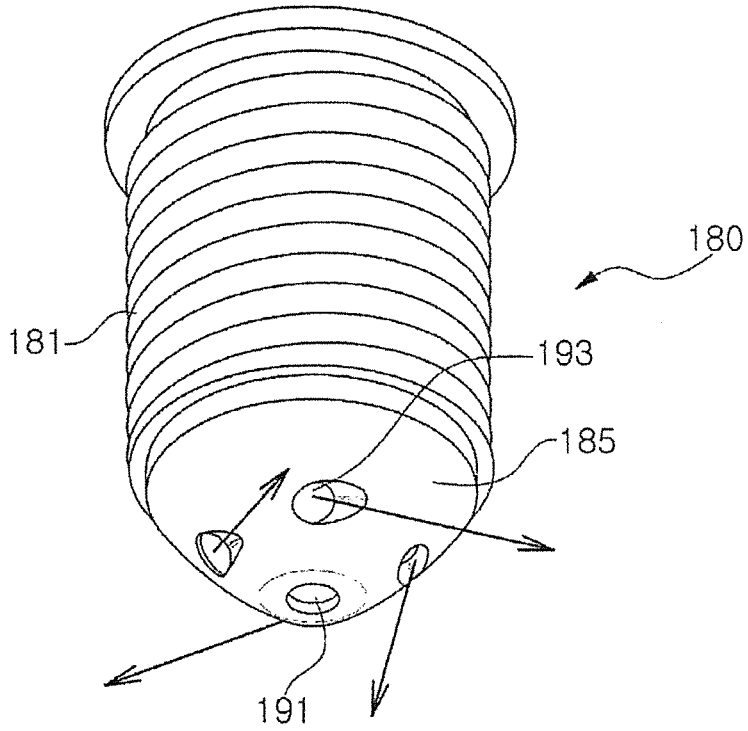
FIG. 4 is a perspective view illustrating the primary combustion chamber forming shell of the spark plug according to the exemplary embodiment of the present invention.
Figure 5:
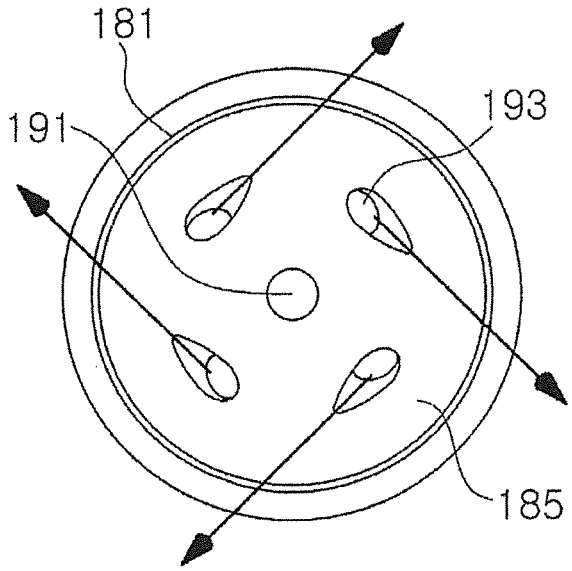
FIG. 5 is a bottom view illustrating the primary combustion chamber forming shell of the spark plug according to the exemplary embodiment of the present invention.

FIG. 4 is a perspective view illustrating the primary combustion chamber forming shell 180 of the spark plug according to the exemplary embodiment of the present invention. FIG. 5 is a bottom view illustrating the primary combustion chamber forming shell 180 of the spark plug according to the exemplary embodiment of the present invention.

The auxiliary ejection hole 193, as illustrated in FIGS. 4 and 5, is preferably inclined laterally to form a vortex of flame discharged into the primary combustion chamber 111. In this structure, since the flame ejected from the primary combustion chamber is transferred to a wider portion of the main combustion chamber, misfire can be prevented and combustion efficiency may be improved.

Figure 6:
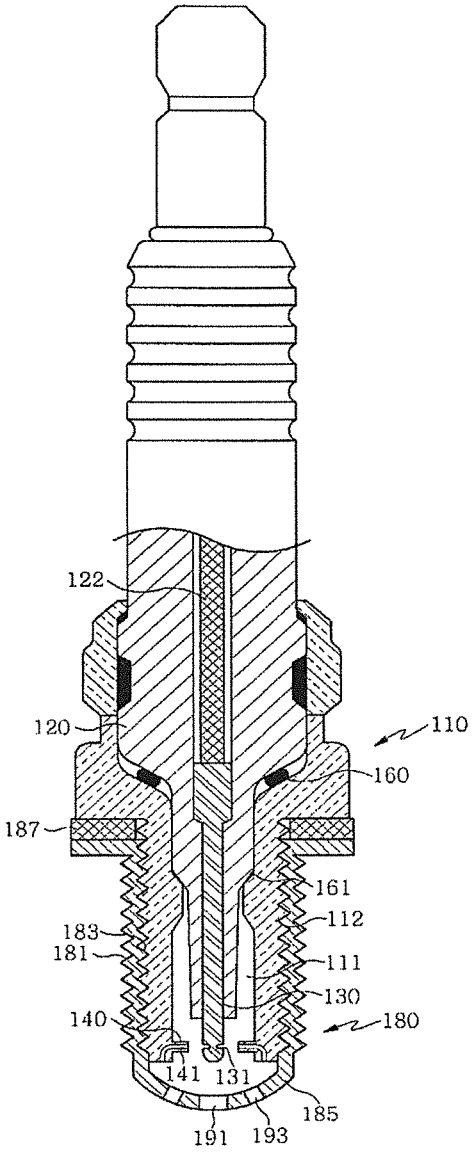
FIG. 6 is a sectional view illustrating according to another exemplary embodiment of the present invention.
Figure 7:
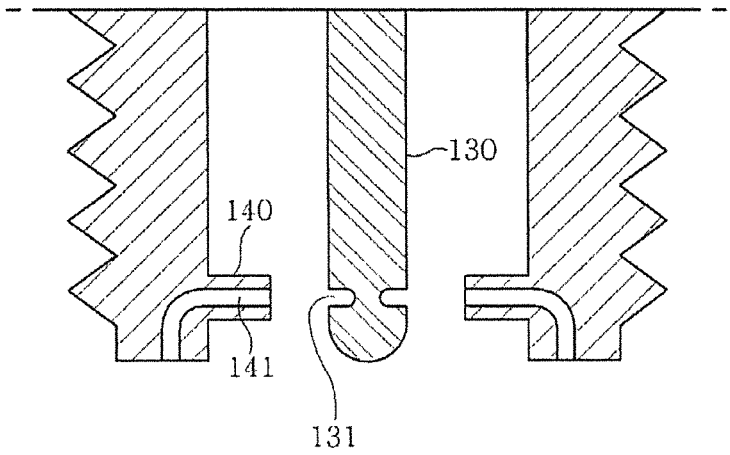
FIG. 7 is a sectional view illustrating structures of a central electrode and a ground electrode of the spark plug according to still another exemplary embodiment of the present invention.

FIG. 6 is a sectional view illustrating according to another exemplary embodiment of the present invention. FIG. 7 is a sectional view illustrating structures of a central electrode 130 and a ground electrode 140 of the spark plug according to still another exemplary embodiment of the present invention.

As illustrated in FIGS. 6 and 7, when a passage hole 141 penetrating a ground electrode 140 is formed, fuel gas mixture stay between the ground electrode 140 and a central electrode 130 for a long time so that misfire can be prevented and efficiency may be also improved.

Moreover, when a recess 131 is formed at a position of the central electrode 130 facing the ground electrode, the residual time of the fuel gas mixture is increased so that misfire can be prevented and efficiency may be also improved.

While exemplary embodiments of the present invention have been shown and described in this specification, it will be understood by those skilled in the art that, various changes or modifications of the embodiments are possible without departing from the spirit and scope of the invention as defined by the appended claims.

The invention claimed is:

1. A spark plug of an internal combustion engine comprising:

a main body having a main thread formed on the lower outer side thereof by a predetermined length;

an insulator mounted in a hollow portion of the main body while coating a terminal rod which is embedded in the central area of the main body with insulating material;

a central electrode extending from lower end of a terminal rod embedded in the insulator to be exposed to the outside;

a ground electrode formed on the lower inside of the main body to correspond to the central electrode;

a primary combustion chamber forming shell having female thread formed on an inner surface of an opening to be screw-coupled with the main thread, male thread formed on the outer surface to fix a combustion chamber, and an ejection hole formed on the lower end;

the primary combustion chamber formed between the main body and the primary combustion chamber forming shell to accommodate the central electrode and the ground electrode and having a volume of which is adjusted by a screw coupling length between the main body and the primary combustion chamber forming shell; and a heat exchange member which is disposed between the main body and the insulator to exchange heat caused by flame generated by ignition by the central electrode and the ground electrode and to block leak of volatile gas;

wherein the ejection hole has a single main ejection hole formed at the central area of the lower end of the primary combustion chamber forming shell and at least two auxiliary ejection holes formed around the main ejection hole in the circumferential direction to be inclined laterally to form a vortex of the flame discharged from the primary combustion chamber.

2. The spark plug as claimed in claim 1, further comprising at least one washer disposed between the main body and the primary combustion chamber forming shell to secure the screw coupling between the main body and the primary combustion chamber forming shell.

3. The spark plug as claimed in claim 2, wherein the washer varies in thickness and number according to a volume of the primary combustion chamber to be disposed between the main body and the primary combustion chamber.

4. The spark plug as claimed in claim 1, wherein the heat exchange member is made of an alloy of copper and hear resistant aluminum or iron.

5. The spark plug as claimed in claim 1, wherein the ground electrode includes two ground electrodes formed around the central electrode symmetrically.

6. The spark plug as claimed in claim 1, wherein the ground electrode includes a penetrating passage hole through which a fuel gas mixture passes.

7. The spark plug as claimed in claim 6, wherein the central electrode includes a recess formed at a site facing the ground electrode to increase residual time of the fuel gas mixture.

* * * * *